US005732670A

United States Patent [19]

Mote, Sr.

[11] Patent Number: 5,732,670

[45] Date of Patent: Mar. 31, 1998

[54] GEARED ROCKER VALVE OPERATION FOR INTERNAL COMBUSTION RECIPROCATING PISTON ENGINES

[75] Inventor: Charles R. Mote, Sr., 2529 W. Poppy Ave., Tucson, Ariz. 85705

[73] Assignee: Charles R. Mote, Sr., Tucson, Ariz.

[21] Appl. No.: 600,481

[22] Filed: Feb. 13, 1996

[51] Int. Cl.[6] ..... F01L 1/30

[52] U.S. Cl. ..... 123/90.24; 123/90.39

[58] Field of Search ..... 123/90.24, 90.25, 123/90.26, 90.39, 90.48, 90.5, 90.61

[56] References Cited

U.S. PATENT DOCUMENTS

| | | | |
|---|---|---|---|
| 2,015,135 | 9/1935 | Brady | 123/90.24 |
| 2,814,283 | 11/1957 | Gassmann et al. | 123/90.24 |
| 2,831,470 | 4/1958 | Lorscheidt | 123/90.24 |
| 2,833,258 | 5/1958 | Lorscheidt et al. | 123/90.24 |
| 3,430,614 | 3/1969 | Meacham | 123/90.24 |
| 3,585,974 | 6/1971 | Weber | 123/90.24 |
| 3,626,469 | 12/1971 | Ashley | 123/90.25 |
| 4,928,650 | 5/1990 | Matayoshi et al. | 123/90.24 |

OTHER PUBLICATIONS

Chevrolet Power By General Motors 2nd Edition page 86 Feb. 1994.

*Primary Examiner*—Weilun Lo

[57] ABSTRACT

An improved design for pushrod operated internal combustion type engines. This invention eliminates the valve spring altogether. In current engines of this type a cam lobe provides the positive upward force to the system to open an intake or exhaust valve and a valve spring provides the constant force to close the valve. This invention uses two cam lobes, an open cam lobe 22 and a close cam lobe 23; two pushrods, and open pushrod 24 and a close pushrod 25; and two geared rockers, a open geared rocker 26 and a close geared rocker 27. A valve stem box retainer 32 is required to pull the valve into a closed position. Positive upward force from the cam shaft is used to both open and close an intake or exhaust valve. The key is that only one of the cam shaft lobes drives the system at a time. If the close valve cam lobe 21 is providing the upward force to close the valve than the open valve cam lobe 20 is not engaged. Since the open and close rockers are geared and engaged into each other, the lifter/pushrod/rocker combination that is not actively driving the valve is controlled by the one that is.

12 Claims, 5 Drawing Sheets

GEARED ROCKER VALVE OPERATION FOR INTERNAL COMBUSTION RECIPROCATING PISTON ENGINES

BACKGROUND

1. Field of the Invention

This field of this invention is in geared intake and exhaust valve operation in internal combustion reciprocating piston engines.

2. Description of the Prior Art

Pushrod operated internal combustion engines typically depend on valve springs to close both the intake and exhaust valves during operation. In order to open the valve the cam shaft uses a single lobe. As the cam shaft turns this lobe pushes against a lifter which by means of a pushrod, rotates a rocker. The rocker arm pushes directly against the valve thereby opening the port. As the cam shaft continues to turn the lifter begins to side down the backside of the lobe which in return begins to eliminate the positive pressure which forced the valve open. Without the positive pressure forcing the valve open, the valve spring pressure forces the valve closed. Pressure from the valve spring also keeps the lifter firmly against the backside of the cam lobe.

This typical operation as described above has several limitations and consequences. To begin with, the valve spring typically requires anywhere from 300 lbs (in production engines) to 1000 lbs (in dragster engines) of over the nose pressure to open the valve. This force is provided by the cam shaft and reduces the overall power output of the engine. Secondly, and more importantly, when an engine begins to turn at a high rate of speed (for example 9000+ RPM for V8 race engines) the valves are moving so fast that the valve springs start to lag behind which results in valve floating. The cam lobe is moving so fast that the valve spring can not generate enough pressure to keep the lifter firmly against the cam lobe. This is precisely the reason that higher pressure valve springs are used in race engines. If the lifter is not kept firmly against the cam lobe throughout the entire cycle, the valve will begin to float and damage will begin to occur to the engine. Most importantly, if the valve spring can't keep the lifter firmly against the cam, the valve may be left protruding into the combustion chamber as the piston begins a compression stroke causing a collision and complete destruction of the engine.

Another problem with valve springs is that they fatigue and fail. They are one of the leading causes of engine failure. When the valve spring fatigues and can no longer keep the valve closed properly, the valve will once again begin to float which will rapidly result in complete engine failure. When a engine fails due to a valve spring, the valve generally falls into the combustion chamber and is smashed by the piston. This results in a complete engine rebuild. In order to run engines at higher RPM stiffer valve springs are used. These respond quicker and exert more pressure against the lifter in order to reduce valve floating. The stiffer a valve spring is, the quicker it will fatigue and fail. Most high performance race engines use very stiff valve springs in order to achieve anywhere from 500 to 1000 lbs over the nose pressure. The fatigue occurs so rapidly that in most cases the engine must be taken apart to replace the valve springs after each race.

To summarize, valve springs severely limit an engine's performance and lifespan. At higher RPM they aren't able to keep the lifter firmly against the cam lobe and the valve begins to float. No matter what material the spring is made of, the constant compression on the spring eventually causes fatigue and failure. This problem is epitomized when racers check and replace their valve springs after each run on a race track.

This invention, eliminates the use of valve springs in an engine altogether. It should be noted that engines types do exist that function without valve springs such as those used by Ducati and Mercedes. However, these desmodromic type engines are very different.

Eliminating the valve spring is of such importance in higher performance engines that many methods have been tried and used. For example, pneumatic actuation and electrical solenoid actuation are but a few. While these types of engines also eliminate the use of valve springs this invention offers an alternative method.

OBJECTS AND ADVANTAGES

This invention offers a solution to the problems discussed above. All pushrod type internal combustion engines will be able to benefit from this invention. Several objects and advantages of this invention are:

a. To provide owners with considerable time savings since frequent checking and replacement of the valve springs will no longer be required. This is especially true for high performance competition engines which must have the valve springs replaced after each race.

b. To provide a means of generating increased engine performance. An engine using this invention will be able to turn at a higher RPM since valve springs failure will no longer be a limiting factor. Constant positive pressure from the camshaft means that the valves will not float. Only the inertia from the mass of the components will limit the maximum RPM achievable.

c. To provide a method of eliminating one of the leading causes (if not the leading cause) of engine failure which is valve spring failure due to fatigue. Therefore, complete engine destruction due to a valve falling into the combustion chamber is highly unlikely.

d. To provide positive valve closing which will allow it to remain open longer resulting in increased horse power.

e. To provide an engine enhancement which will give pushrod type engines higher reliability and a longer expected life cycle.

This invention will enable owners and manufactures of existing pushrod type internal combustion type engines to modify it in such a way as to eliminate the valve spring. The engine block, piston, crankshaft, and most other parts will remain untouched whereas a new camshaft, pushrods, rockers, and valve stem box retainer will be required. This invention may also be used when designing and building a new engine from the ground up rather than modifying an existing one.

DRAWING FIGURES

In the drawings, closely related figures have the same number but different alphabetic suffixes.

FIGS. 4A through 4D together, illustrate the operation of the this invention and each figure shows a different phase of the operating cycle of a valve.

Figure 5A:
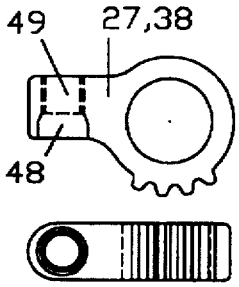
Figure 5B:
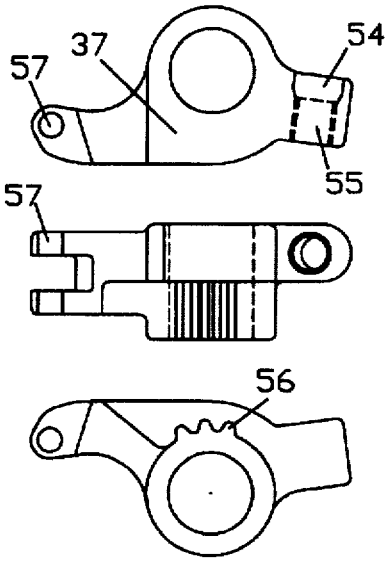
Figure 5C:
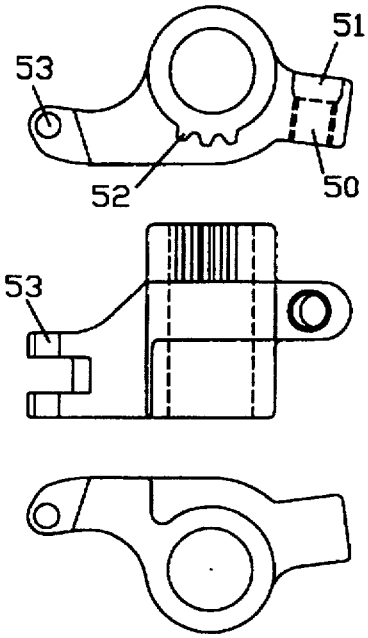

FIGS. 5A through 5C show each of the 3 types of geared rockers used to actuate the intake and exhaust valves.

Figure 6A:
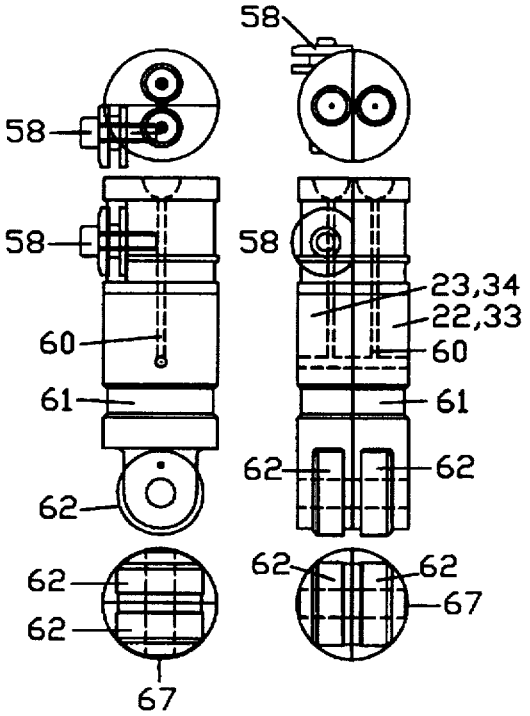
Figure 6B:
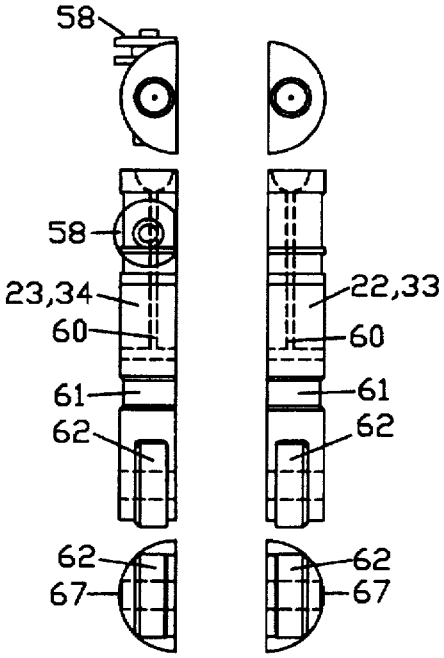

FIGS. 6A and 6B show the double lifter assembly which is comprised of an open and close lifter pair which are used to lift the two pushrods that each valve requires.

DESCRIPTION—FIGS. 1 TO 6

Figure 1:
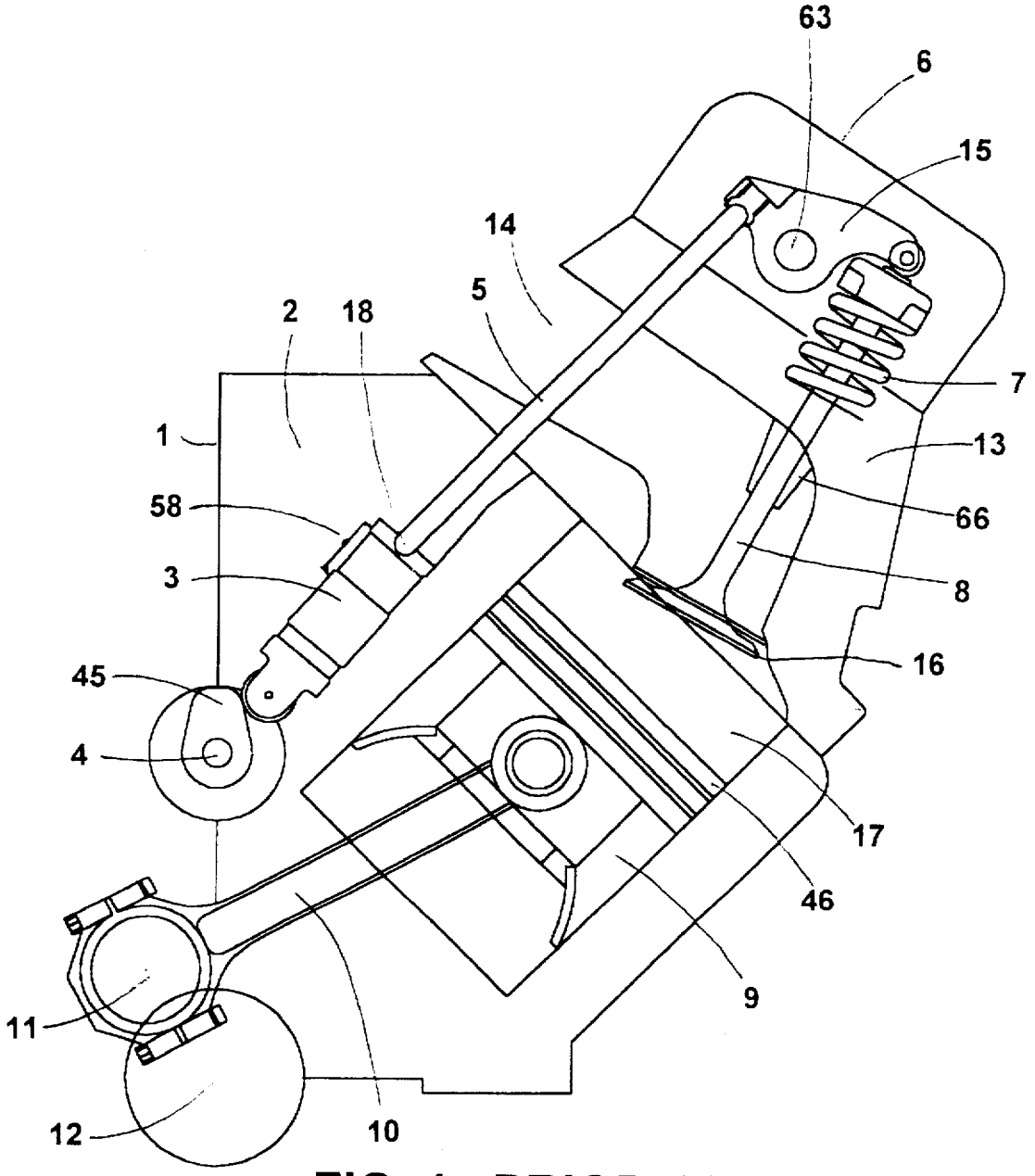
FIG. 1. PRIOR ART
FIG. 1 is for reference only and is a cross-section assembly of a typical pushrod type internal combustion engine in which the intake valve is shown.
Figure 2:
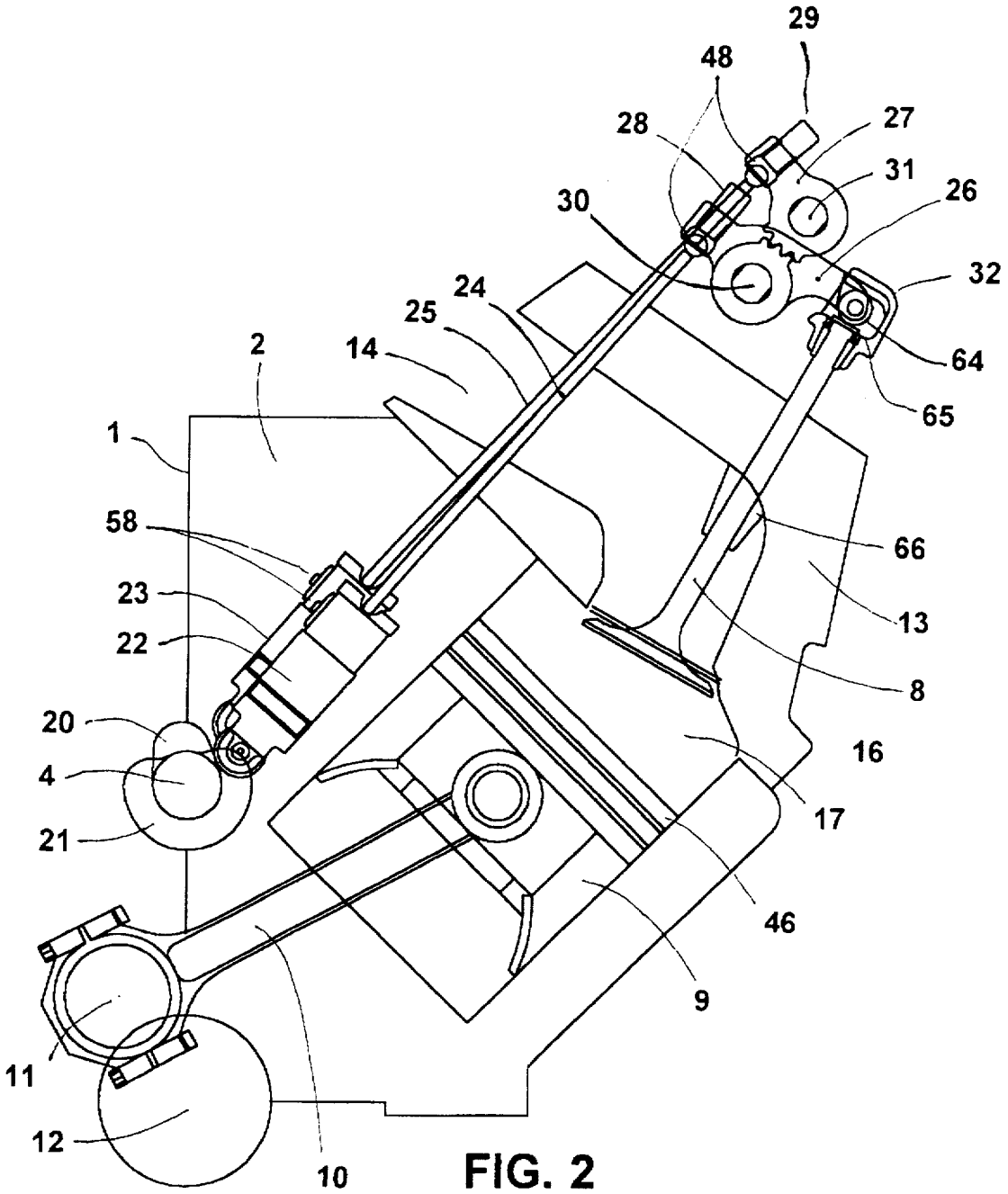
FIG. 2 is a cross-section assembly of a modified pushrod type internal combustion engine (showing the intake valve) which incorporates this invention in order to operate the valve.

FIG. 1 shows a typical pushrod type internal combustion type engine. It is presented as a foundation so that the invention of FIG. 2 is more readily understood. Although only the intake pod valve assembly is shown in this diagram, the exhaust port valve components are similar to the intake port. In a typical assembly, the cam shaft 4 has only one lobe per valve 8. This single lobe 45 has a lifter 3 which rides along it's outer circumference. The lifter 8 joins to a pushrod 5 which is inserted into the top end of the lifter. The pushrod 5 is a long steel rod with a rounded end on both sides. The rounded end on the bottom of the pushrod 18 fits into the top of the lifter 3 in a smooth circular pocket. The round end on the top fits into a smooth circular pocket in the inside pad of the rocker arm 15. The rocker arm 15 is mounted on a single rocker arm shaft 63. On one side of the rocker arm 15 the pushrod is mounted 5 and in the other side a roller presses against valve spring 7 and the top of the valve stem 8. The valve stem 8 has a valve head 16 which is what opens and closes the intake port 14. The valve guide 66 surrounds the valve stem 8 so that the valve is restrained. The connecting rod 10 is a steel piece that connects to the piston 9 at a center point on a rotating pivot point. The other end of the connecting rod is connected to the connecting rod journal 11 which is part of the crankshaft 12. The piston 9 slides up and down the cylinder bore and is connected to the crankshaft 12 via a connecting rod 10.

FIG. 2 shows a typical embodiment of the present invention. Just as in FIG. 1, only the intake port valve assembly has been shown. The components used in the assembly of the exhaust port are almost identical and only differ slightly in some of the dimensions. It is for this reason that while describing the assembly, adding the repetitive descriptive phrase "for the intake port" has been omitted. In this illustration all of the components which operate the valve shown are for the intake port. However, the description below would be identical for the exhaust port as well.

In this assembly, the valve spring has been eliminated since it is no longer needed for engine operation. The cam shaft 4 now has two lobes per valve. The open lobe 20 and the closed lobe 21. These lobes are still constructed of steel and are now ½ as wide as before so that they may fit into the same width profile as the single lobe. The open lobe 20 has the open lifter 22 which rides along its surface. This open lifter 22 uses either a polished surface (standard engines) or a roller with needle bearings (in high performance engines) to ride along the surface of the open lobe 20. The closed lobe 21 has the close lifter 23 which rides along it's surface. This close lifter 23 also uses either a polished surface (standard engines) or a roller with needle bearings (in higher performance engines) to ride along the surface of the close lobe 21. A open lifter 22 is shaped in the form of an extruded semi-circle as is the close lifter 23. When these two lifters are placed next to each other they form a full circle which is similar to the old type single lifter that they are replacing. Each of the two lifters have a smooth spherical pocket in the top in which one end of a pushrod (24 or 25) is inserted into and may move about freely. Both lifter roller surfaces are polished as to reduce friction. Both of the open 22 and close 23 lifters retain oil galleys and oil reservoirs similar to the current production type lifters found today. A lifter guide plate 58 is used to prevent both the open 22 and close 23 lifters from rotating. This is required when roller type lifters are used to keep them in alignment with the cam shaft 4. A open push rod 24 is located between the open lifter 22 and the short or inside arm of the open rocker 26. Likewise, a close push rod 25 is located between the close lifter 23 and the short or inside arm of the close rocker 27. Both of these pushrods are made of steel. A smaller pushrod diameter is permissible since they will no longer have the 300 lb–1000 lbs of valve spring pressure against them. However, since the motor will now be capable of increased RPM the diameter may need to remain the same (as current production pushrods) in order to support the increases in rocker and valve inertia. A open geared intake port rocker 26 pivots about the open rocker shaft 30. Both open rockers for both the intake and exhaust ports rotate about the open rocker shaft 30. Similarly the geared close rocker 27 rotates about the close rocker shaft 31. The geared close rockers are identical for both the intake and exhaust ports and rotate about the same close rocker shaft 31. The geared open rocker 26 has three gear teeth in it's top side which engage the four gear teeth found in the bottom of the close rocker 27. Fewer and larger gear teeth provide increased durability and strength. Heat treated tool steel is used to construct the gear teeth to minimize wear and ensure reliability. The gear teeth tolerances are kept within one-thousandths of an inch in order to minimize gear backlash. A close rocker shaft adjust screw 29 contains a spherical close rocker arm cavity 48 formed in its bottom end in order to accommodate the top rounded end of the close valve pushrod 25. By turning this screw up and down, which tightens and loosens the operating clearance of the close valve pushrod 25, the close valve system may be adjusted in order to minimize lash. A open rocker shaft adjust screw 28 contains a spherical open rocker arm cavity 51 formed in its bottom end in order to accommodate the top rounded end of the open valve pushrod 24. By turning this screw up and down, which tightens and loosens the operating clearance of the open valve pushrod 24, the open valve system may be adjusted in order to minimize lash.

The open rocker 26 is constructed with a fork at the end of it's outside or valve side arm. This fork is used to hold a roller bearing 64 which pushes against the top of the valve stem 8. A valve stem box retainer 32 is pinned to the top of the valve stem 8. The valve stem 8 is different from standard valve stems in that it contains a hole near it's top in which a retainer pin may be inserted. The valve stem box retainer 32 encircles the open valve rocker arm 26. The valve stem box retainer 32 is a new pad which is made of steel and constantly retains the top of the salve stem at all times.

Similar to most engines the valve stem 8 is supported by a valve stem guide 66. A valve head 16 is connected to the valve stem and provides the seal or open/close action for the intake port 14 (or similarly the exhaust port). A piston 9 is connected to the crankshaft 12 by means of a connecting rod 10. A journal 11 from the crankshaft is attached to one end of the connecting rod 10 and a piston 9 is connected to the other end. The piston 9 is inside a combustion chamber 17.

Figure 3:
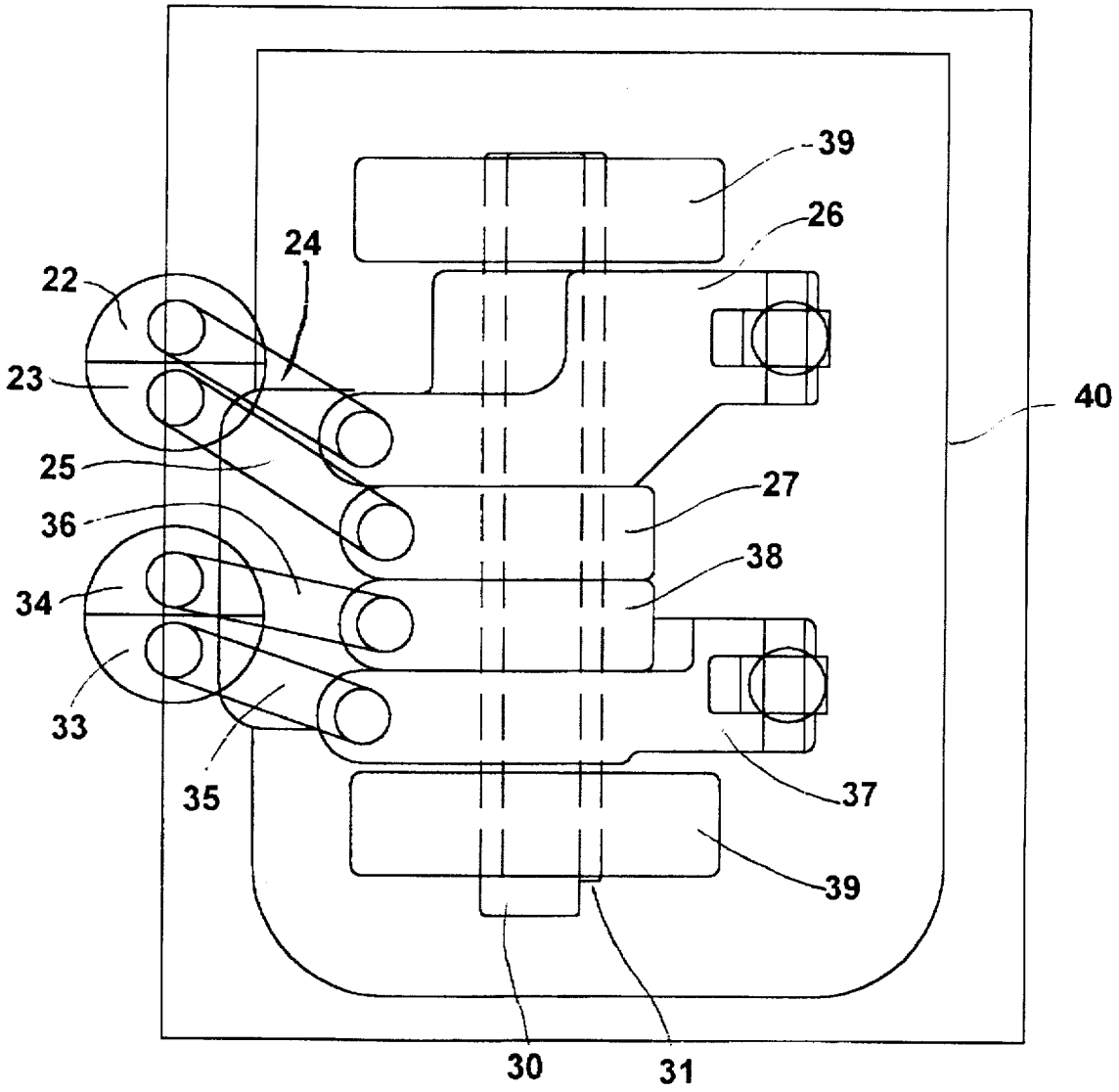
FIG. 3 is a top view of the assembly of FIG. 2 except the top view of the exhaust valve assembly has been included.

FIG. 3 shows a top view of FIG. 2. However, the exhaust port and it's corresponding valve operating components have been included. As seen from this top view, both the intake and exhaust port valve operation is identical. The only difference is that some of the dimensions are slightly different between the two. A open rocker shaft 30 serves as the pivoting point for both the geared open intake rocker 26 and the geared open exhaust rocker 37. A close rocker shaft 31 serves as the pivoting point for both the geared close intake rocker 27 and the geared close exhaust rocker 38. Both the open rocker shaft 30 and the closed rocker shaft 31 are spaced apart as to optimally engage the gear teeth of an open and close geared rocker pair. A geared close intake rocker 27 resides physically on top of it's corresponding geared intake open rocker 26. Similarly, a geared close exhaust rocker 38 resides physically on top of it's corresponding geared exhaust open rocker 37. Rocker shaft support pieces 39 hold both the open rocker shaft 30 and the close rocker shaft 31 in place. A open intake valve pushrod 24 transfers force from the open intake lifter 22 to the inside arm of the geared open intake rocker 26. A close intake valve pushrod 25 transfers force from the close intake lifter 23 to the arm of the geared close intake rocker 27. A open exhaust valve pushrod 35 transfers force from the open exhaust lifter 35 to the inside arm of the geared open exhaust rocker 37. A close exhaust valve pushrod 36 transfers force from the close exhaust lifter 34 to the arm of the geared close exhaust rocker 38.

FIGS. 4A through 4D are identical to FIG. 2 with respect to the components shown. The difference is that FIG. 4 depicts four different operating phases of the invention. Therefore, refer to FIG. 2 for the component descriptions of FIG. 4. FIG. 4 will be discussed in detail under the operation section of this document.

FIGS. 5A–5C show the geared rockers in greater detail. FIG. 5A shows both a geared close intake valve rocker 38 and a geared close exhaust rocker 27. These two close rocker types are identical and therefore only one Figure is used to show them both. A exhaust or intake close rocker consists of a perfectly circular opening in which the close rocker shaft 30 passes through. The single inside arm of a close rocker contains a threaded opening 49 on it's top in which a close rocker lash adjust screw is inserted. On the bottom of the single arm is a spherical smooth cavity in which the top end of a close valve pushrod (25 or 36) is inserted. FIG. 5B is a geared exhaust open rocker 37 which has a perfectly circular opening in which the open rocker shaft 31 passes through. The inside or short arm contains a threaded opening 55 on it's top in which a open rocker lash adjust screw is inserted. On the bottom of the inside arm is a spherical smooth cavity in which the top end of a open exhaust valve push rod 35 is inserted. On the long or outside end of the geared open exhaust rocker 37 is a exhaust open rocker valve stem roller fork 57 in which a cylindrical roller bearing is placed. FIG. 5C is a geared intake open rocker 26 which has a perfectly circular opening in which the open rocker shaft 31 passes through. The inside or short arm contains a threaded opening 50 in which a open rocker lash adjust screw is inserted. On the long or outside end of the geared open intake rocker 26 is a intake open rocker valve stem roller fork 53 in which a cylindrical roller bearing is placed. A valve stem box retainer 32 is attached to the valve stem 8 by keepers and a pin and surrounds the fork 53.

FIG. 6A–6B show the split lifters in greater detail. Since a intake valve pair of lifters are identical to a exhaust valve pair of lifters, one set of drawings has been used to illustrate them both. FIG. 6B illustrates a open—close valve lifter pair before they are placed together. Each lifter exhibits a elongated semicircular shape which when placed with it's complement, forms a cylindrical entity in which the two halves are able to move up and down with respect to one another. A open intake valve lifter and a close intake valve lifter form a cylindrical pair. Also, a open exhaust valve lifter and a close exhaust valve lifter for a cylindrical pair. Since each valve requires a pair of split lifters to open it, and there are two valves per cylinder, there are four split lifters or two lifter pairs per cylinder. For simplicity, the term "split lifter" will refer to all of the four split lifter types (i.e.: a open intake valve lifter, a close intake valve lifter, a open exhaust valve lifter, and a close exhaust valve lifter). This is desirable since most lifter features apply similarly to all four lifter types. A split lifter has a spherical smooth pocket at the top where the bottom end of a valve push rod (24,25,35, and 36) may rest. The top of a split lifter where the smooth pocket resides is made of hardened tool steel so that the spherical smooth pocket is resistant to wear. A split lifter has oil galleys 60 inside both vertically and horizontally.

These oil galleys are similar to existing single lifters and provide lubrication and a path for oil to flow up the push rods. Oil reservoirs 61 are also present (similar to existing lifters) to provide additional lubrication for the lifter. A lifter roller 62 is mounted into a fork at the bottom of a split lifter. This lifter roller is held by a lifter roller shaft 67 which mounts into the fork at the split lifter bottom. One of the split lifters in a split lifter pair contains a lifter guide plate 58 to ensure that the split lifter pair does not rotate around it's long axis. This is required whenever roller lifters 62 are used to maintain alignment with respect to the cam shaft lobe that they are riding upon.

Both the rockers shown in FIGS. 5A–5C and the lifters shown in FIG. 6A–6B were manufactured with hardened tool steel in order to ensure both durability and an extended life. However, they could be made of any material which provides these features.

From the description above, a number of advantages of my double pushrod modified internal combustion engine become evident.

A. Most current engines in production could be modified to use this invention. Therefor the benefits of this invention are available to all current and future engine owners.

B. The new valve operating assembly requires no springs of any type which have historically been the weak link in engine performance and reliability. Thus the new assembly is much more robust and problem free.

C. Engine speed will no longer be restrained by the operating characteristics of a valve spring. Now only the internal mass of the assembly components will limit the speeds obtainable.

D. Race engines which incorporate this invention will have a substantial performance advantage over those who do not. Positive valve closing derived from the addition of a cam lobe, a second lifter, a second pushrod, and a pair of geared rockers will enable the valve to remain open longer which will generate more horsepower and support higher RPM.

E. Engines which incorporate this invention will require less maintenance than those that use valve springs. This is especially true for high performance race engines. Less maintenance can be translated directly into financial savings.

OPERATION—FIGS. 1 TO 6

The operation of my double pushrod and geared rocker internal combustion engine is such that a valve spring is no longer required and therefore the engine performance and life expectancy is greatly enhanced.

First, a few concepts will be anchored by using FIG. 1 as a reference point. In FIG. 1, when the open lobe on cam shaft for the intake pod 20 begins to lift the intake valve lifter 3, a positive upward force is generated, which by means of a push rod 5 and a intake valve rocker 15, is transmitted directly to the intake valve 8 which is then pushed open into the combustion chamber 17. In order to accomplish this, the positive upward force generated by the open intake port cam lobe 20 must overcome the compression force generated by the valve spring 7. As the intake valve lifter 3 slides down the backside of the open intake valve cam lobe 20, there is no longer any positive upward force occurring in the assembly. Only the energy stored in the valve spring exists to bring the valve back to it's seated position and close the intake port. This energy is stored energy and since it is directed back toward the cam shaft to close the valve, it could be called negative energy. This same valve spring must also actuate the rocker back to its original position and drive the intake valve lifter 3 back against the cam shaft 4 by means of the intake valve push rod 5. Therefore, correct operation of a pushrod type internal combustion engine depends on (and is limited by), the negative or stored energy that the valve spring 7 contains, which is used to complete the valve cycle.

This invention eliminates the need for negative stored energy since it uses positive force taken from two cam shaft lobes to both open and close the valve. Although the discussion below will be using the intake port valve operation to describe this invention, the exhaust pod valve operation is identical and is included as part of this invention. The operation of this invention is as follows:

Basic embodiment of operation:

FIGS. 2 and 4A through 4D are used to describe the operation of this invention. For each valve this invention requires for there to be two lifters, two lobes on the cam shaft (one for each lifter), two pushrods, and two geared rockers. With this configuration there is always a positive pressure generated by the cam shaft 4 to operate the valve 8.

Detailed step-by-step operation:

FIGS. 4A–4D are used to detail the step-by-step operation of this invention. A complete open and close cycle of the intake port valve has been shown to illustrate complete operation.

Figure 4A:
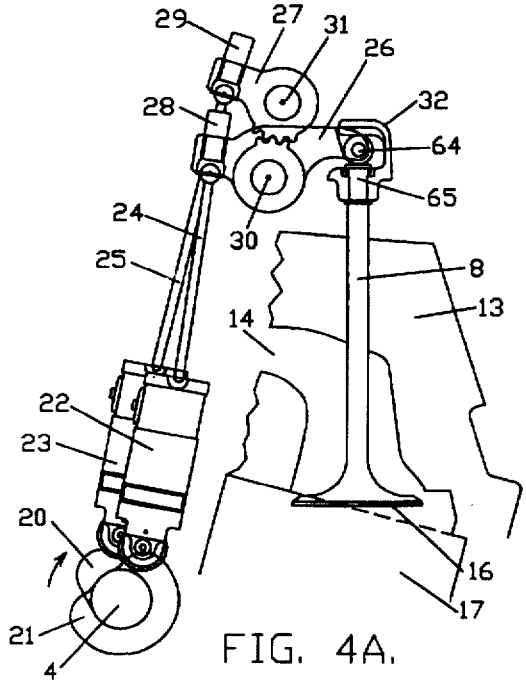
Figure 4B:
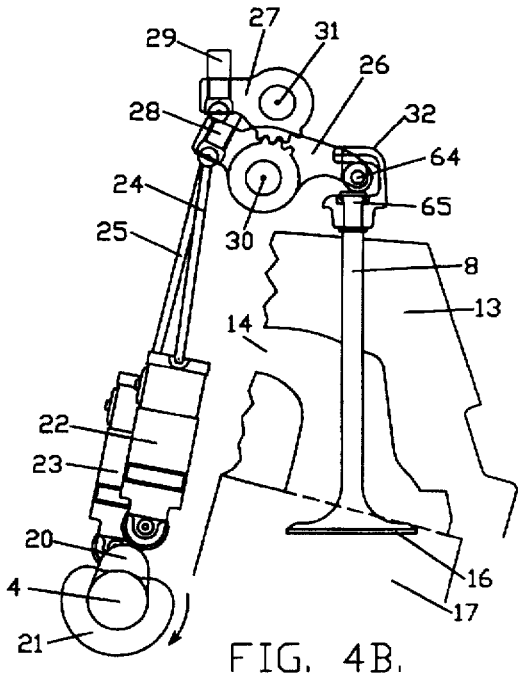
Figure 4C:
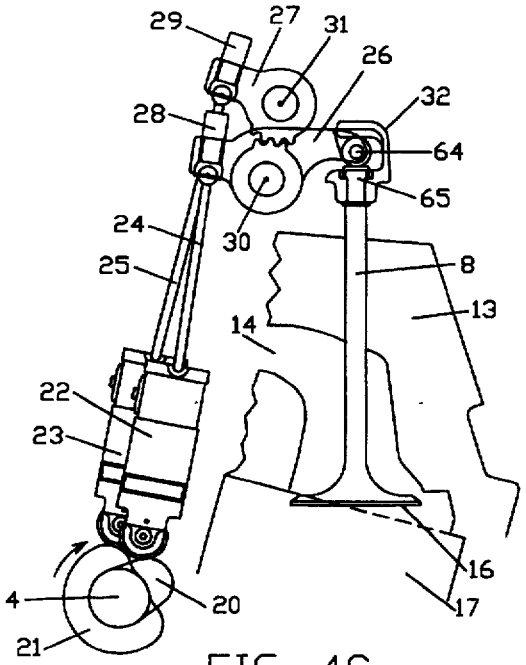
Figure 4D:
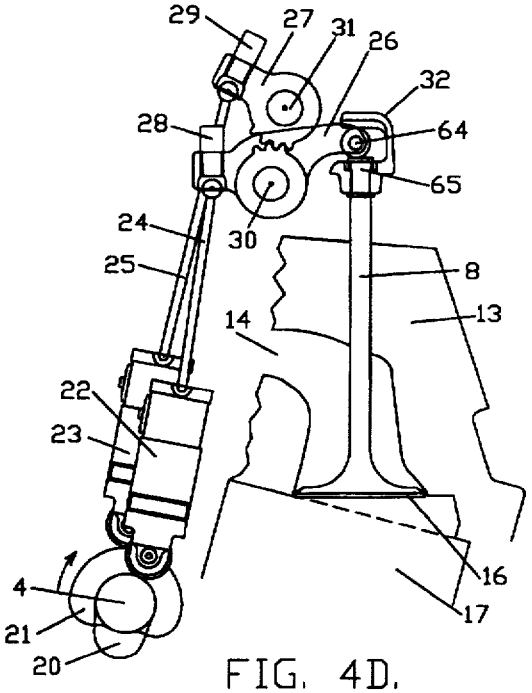

Starting with FIG. 4A, the intake valve 8 is beginning to open. As the open intake valve lobe 20 rotates into it's corresponding open intake valve lifter 22 positive pressure is exerted against the lifter. The positive pressure is generated due to the increasing radius of the open intake valve cam lobe 20 which directly increases the displacement of the open intake valve lifter 22 with respect to the center of the cam shaft 4. This positive upward force is then transferred directly to the inside arm of the geared open intake valve rocker 26 by means of the open intake valve push rod 24. The open intake valve rocker 26 pivots around the open rocker shaft 30 which forces the outside arm of the open intake valve rocker 26 downwards. This downward force is placed directly on the end of the valve stem 65 which results in the valve head 16 moving into the combustion chamber 17. When the intake port valve head 16 is forced into the combustion chamber the intake port is said to be open, thereby allowing gases to flow from the intake pod 14 into the combustion chamber 17. As the geared intake valve open rocker 26 moves clockwise (CW) in order to open the intake port as described above, it's gears forcibly engage the gears of the intake port close rocker 27. Since the gears of the intake port open rocker are moving CW as the open intake port rocker 26 is opening the port, the gears of the close intake port rocker 27 are forced counterclockwise (CCW) thereby rotating the entire close intake rocker CCW as well. This CCW movement of the close intake port rocker results in the inside arm of the rocker moving downward and exerting force on the close intake rocker pushrod 25. This downward force is further propagated to the close intake valve lifter. As a result the intake valve close lifter 23 is forcibly kept to within a few thousands of an inch from the downward sloping and backside of the close intake valve cam lobe 21. It is extremely import to note that only ONE intake port lifter is exerting positive upward force on the system at a time. When it is the open intake valve lifter 22, as shown in FIG. 4A, that is exerting this positive upward force, the other lifter, the close valve lifter is not experiencing any upward force from it's cam lobe whatsoever. In fact, it is being forcibly held within a few thousandths of an inch (or just touching) the backside of it's cam lobe by the positive force from the open intake valve lifter 22. This is accomplished by precise dimensions on the open and close valve cam lobes. The open intake valve lifter 22 continues to ride higher and higher on the open intake valve cam lobe 20 until it reaches it's peak. At this peak, shown in FIG. 4B., the intake valve is fully extended into the combustion chamber 17 and the intake port 14 is said to be fully open. It is at the exact peak of the open intake valve cam lobe 20 that the transfer of positive force into the assembly from the open intake valve lifter 22 to the close intake valve lifter 23 occurs. At this point both of the geared rockers, both of the pushrods, and the valve stop their current direction of motion and reverse it. The instant the open intake valve lifter 22 begins to ride down the backside of it's open intake valve cam lobe 20, it is no longer exerting positive upward force into the system. This is because the close intake port lifter has just begun to ride up the increasing slope of it's close intake port cam lobe 21 and is now exerting positive upward force into the system. As the open intake port lifter rides down the backside of it's open intake port cam lobe 20, it rides just above and barely touches the surface of it's open intake port cam lobe 20. FIG. 4C shows the intake valve 8 closing. As the close intake port lifter 23 rides up the rising edge of the close intake port cam lobe 21, positive upward force is transferred to it. Once again, this is due to the increasing radius from the center of the cam shaft 4 and the surface of the close intake port cam lobe which is making contact with the roller on the close intake port lifter 23. This upward positive force is transferred directly to the inside arm of the close intake valve rocker 27 via the close intake port pushrod 25. This positive upward force on the inside arm of the close intake port rocker 27 causes the rocker to rotate CW about the close rocker shaft 21. This rotation causes the gears located at the bottom of the close intake rocker 27 to forcibly engage the gears located on the top of the open intake valve rocker 26. This engagement forces the open intake valve rocker 26 to rotate CCW about the open rocker shaft 30. The CCW movement causes the outside arm (or valve stem side arm) to move upward which then pulls the valve 8 upward, thereby forcibly moving the valve head 16 toward a closed position. This upward pull of the valve stem 8 is made possible by the valve stem box retainer 32 which is held in place on the valve stem by keepers and a safety pin. The valve stem box retainer 32 engages the capped or widened portion found at the top of the valve stem 65 in order to pull the valve upward. The roller bearing 64 is pushing against the top surface of the valve stem box retainer in order to transfer the upward force from the outside arm of the open intake valve rocker 26 to the valve stem box retainer 32. The CCW movement of the open valve intake valve rocker 26 also causes downward motion of it's inside arm which in return pushes downward on the open intake port pushrod 24. The open intake pushrod 24 pushes downward against the open intake port lifter 22. The open intake valve lifter 22 is pushed downward so that it's roller 62 is within a few thousandths, or just touching, its associated open intake valve cam lobe 20. Once the surface of the close intake cam lobe 21 ceases to increase (that is it's radius with respect to the center of the cam shaft 4), there is no longer any positive upward force being actively transferred into the system. However, while the close intake valve lifter 23 is riding along the raised outer surface of the close intake cam lobe 21, the system is locked into place and no lifter or geared rocker movement occurs. It is during this phase of operation that the valve is motionless and closed tightly against the intake valve seat (with the help of cylinder compression). As the cam shaft 4 continues to rotate around in it's CW path, the close intake valve cam lobe 21 will eventually begin to taper off and decrease in radius with respect to the center of the cam shaft 4. The instant the this begins to occur the open intake valve cam lobe 20 begins to take control of the geared rocker system by exerting positive upward force on it's associated open intake valve lifter 22. At this point in the operational cycle the system is back at the beginning point of this operational description. This cycle of the two cam lobes, the two pushrods, and the two geared rockers repeatedly opening and closing the valve is the principle embodiment of this invention.

As shown from the operational description above, only one lifter may exert positive force on the system at a time. When one lifter is forcibly driving the system the other lifter is being driven by it. Therefore, it is the position of the lifter that is in control of the system that determines the position of the valve, both rockers, both pushrods, and the other lifter. One can think of it as a master and slave relationship. Whichever lifter is exerting positive force into the system is the master and the entire system is slave to it (including the other lifter). Needless to say, since the position of the slaved lifter is determined by the master or actively pushing lifter, the clearance between the slaved lifter and it's cam lobe is important. The slaved lifter should be kept as close to it's cam lobe as possible so that the transition point to where it becomes the positive driving force of the system is as smooth as possible.

The intake valve system discussed above is fine tuned or calibrated by turning the open rocker shaft adjust screw and the close rocker shaft adjust screw. As these screws are turned clockwise they lower the position of their corresponding rocker pushrod cavities. For example, in order to tune the open intake valve pushrod assembly, the open intake valve shaft adjust screw 28 would be turned CW into the threads 50 located in the top of the inside arm of the open intake valve rocker 26. The result would be that the open intake valve rocker pushrod cavity 51 will be forced slightly closer toward the cam shaft (downward). This reduces the distance allocated in the system for the open intake port pushrod 24 and open intake port lifter 22 thus closing or tightening the assembly. The key is to turn the cam shaft 4 until the open intake port lifter is sliding along the backside of the open intake valve cam lobe 20. The intake open valve shaft adjust screw should then be tightened (CW) until the roller 62 of the open intake valve lifter 22 is just touching or within a couple thousandths of touching the surface of the open intake valve cam lobe backside. The backside of the open intake valve cam lobe 20 may be defined as any point along the cam lobe surface that has the smallest radius with respect to the center of the cam shaft 4. The intake valve close adjust screw 28 should be used to adjust the close intake valve components in an identical fashion as described above for the open intake valve components. When setting the optimal adjustment both operating clearance and thermal expansion should be taken into account.

The operation description of the intake valve system discussed above applies in an identical fashion the exhaust pod as well. The only difference is that instead of using the word "intake" to describe the components in the system, the word "exhaust" would be used instead. In the interest of conciseness and length, replicating the above description using the word exhaust instead of intake has been avoided. This patent is intended to cover both the intake and exhaust valves. This patent is also intended to cover multiple intake and exhaust valves per cylinder, sleeve type valves, and sliding valves.

SUMMARY, RAMIFICATIONS, AND SCOPE

As seen by the description and operational discussion presented above, this invention offers many advantages and benefits by replacing the valve spring in pushrod type internal combustion engines and replacing it with a positive closing mechanism which derives it's force directly from the cam shaft. Without the negative liabilities of a valve spring, engines based on this invention will be able to turn at much higher Rpm's and run for a significantly longer periods of time before requiring servicing. This invention has the following additional advantages.

It permits all current owners of pushrod type internal combustion engines to upgrade their engine by the new components of this invention. They will be able to use their existing engine block, crankshaft, pistons, and manifolds. Therefore, this invention is not limited only to new production engines but to all pushrod operated reciprocating valve internal combustion engines in existence.

It provides a means by which the reliability of internal combustion engines will be greatly enhanced. Valve springs are one of the leading causes of engine failure and when a valve spring causes the failure, it is usually catastrophic resulting in complete engine rebuilds. Race engines will no longer have to resort to high tensile strength valve springs which require constant replacing (usually after each race). These high tensile strength valve springs are an even greater liability since they fatigue quickly.

It provides a means to realize financial savings in particular for those who operate internal combustion engines for the purpose of competition and racing. Since the engine will not have to be torn down after each race to check the valve springs and/or replace them, a user of this invention should be able to recover the expense of the modification after only a few events.

It provides a means by which internal combustion engines are able to operate at much higher sustainable speeds or RPM than before. By using positive force driven from a cam shaft lobes to close the valve as well as open it, valve floating due to the inability of a valve spring to close the valve quick enough will no longer occur. The engine will be able to easily exceed it's previous speed limitation. The only factor which will limit the engines speed will become the inertia of the system components It provides a means by which the efficiency and strength of internal combustion engines may be increased. This is made possible by replacing the valve springs by a valve closing mechanism which derives it's force directly from the cam shaft. While opening the valve, the cam shaft will no longer be required to overcome the constant resistance presented by the valve spring.

Although the description above contains many specifications, these should not be construed as limiting the scope of the invention but as merely providing illustrations of some of the presently preferred embodiments of this invention. For example, the split lifter pair which are comprised of an open and close lifter may be other shapes other than two half cylinders which form a full cylinder when placed together. Each individual lifter may be rectangular, square, cylindrical, etc. They may be shaped to form an obvious pair or each lifter may be shaped independently of the other. The pushrods may also be a different shape other then cylindrical rods with spherical ends. The rod shaft may be any shape so long as it is able to transfer energy from one end to the other. The spherical ends may be somehow keyed or use some other method of engaging the components surrounding it (namely a rocker type and a lifter type). The geared rockers especially may be of any shape and the gear teeth may engage at a different location with respect to rest of the assembly. It is also possible that the geared open rocker may be physically located above or behind the geared close rocker. The open and close rocker shafts may be located in different positions than shown in the figures attached. The valve stem box retainer may be a different shape which is able to effectively engage the valve stem in order to pull it up out of the combustion chamber. It may be circular, or even some combination of pins and brackets.

The operation of the valve by the two geared rockers does not necessarily require a lifter and pushrod. An overhead cam may be used to actuate directly (or indirectly), the geared rockers. In this type of embodiment, the overhead would still incorporate two cam lobes per valve just as in the pushrod operated version. Preferably, the overhead cam lobes would directly actuate the geared rockers. However, a means of transferring energy from the overhead cam lobes to the geared rockers such as: connecting rods, shafts, pins, and enclosures, would also function suitably well.

All of the components of this invention do not have to be made of hardened tool steel as the original evaluation model was. Any material which proves to be durable and wear resistant enough to provide adequate performance would do. For example, titanium, and some ceramics may work perfectly well. Also combinations of materials would suffice such as using hardened steel only at locations of contact and mild steel or aluminum for the majority of the components mass.

While a preferred embodiment of the invention has been presented and described, it will be appreciated that there is no intent to limit the invention by such disclosure. Rather, the disclosure is intended to cover all modifications and alternate embodiments falling within the spirit and the scope of the invention as defined in the appended claims.

I claim:

1. A valve operating mechanism in an internal combustion pushrod operated reciprocating piston engine which eliminates the use of a valve spring comprising:

a) a valve;

b) a pair of geared rockers for each valve whose gears are mutually engaged, wherein the movement of said geared rockers is interdependent and wherein each of said rockers reciprocate on a respective shaft so as to control an opening and closing operational cycle of said valve;

c) a retaining mechanism located at an end of one of said geared rockers which engages at the top end of said valve stem to provide a means of connectivity between said geared rockers and said valve throughout the operational cycle;

d) a cam shaft located below said pair of geared rockers which incorporates two different cam lobes per valve, wherein one lobe provides the energy required for valve closing, and the other lobe provides the energy required for valve opening;

e) a pair of lifters per valve, each of the lifters rides upon one of said cam lobes of a cam shaft wherein the energy which is obtained from each respective said cam lobes is directed linearly upward toward each respective said geared rocker arms; and f) a means of transferring the energy from each of said lifters to each of said geared rockers.

2. The valve operating mechanism of claim 1, wherein said pair of geared rockers, lifters, cam lobes, and energy transferring means are arranged into a valve opening set of members and a valve closing set of members, wherein each set contains one member of each pair, and the design of each set is such that one set opens the valve, and the other set closes the valve.

3. The valve operating mechanism of claim 1, wherein a surface of said other cam lobe provides the upward positive force required to open said valve, and the surface of said one cam lobe provides the upward positive force required to close said valve in such a manner that only one of said cam lobes in a pair provides positive upward force at a time.

4. The valve operating mechanism of claim 1, wherein said means of transferring energy from each of said lifters to each of the geared rockers is at least one of a metal pushrod and a ceramic pushrod.

5. The valve operating mechanism of claim 1, wherein each of said lifters includes a roller assembly to engage said respective cam lobe.

6. The valve operating mechanism of claim 1, wherein each of said lifters is an individual member requiring its own lifter guide bore in an engine block.

7. The valve operating mechanism of claim 1, wherein each of said pair of lifters is shaped substantially semi-circular in cross section such that when placed slidably together in a pair they form a substantially circular cylindrical assembly which is guided by a single lifter bore in an engine block.

8. The valve operating mechanism of claim 1, wherein said valve operating mechanism modify an existing engine whereby many components from the existing engine may be reused with minor modifications.

9. A valve operating mechanism in an internal combustion reciprocating piston engine comprising:

a) a pair of geared rockers for each valve whose gears are engaged with one another, wherein the movement of said geared rockers is interdependent, and each of said rockers reciprocate on a shaft so as to control an opening and closing of said valve;

b) a pair of cam lobes per valve, the lobes are located on a cam shaft and below said geared rockers, wherein one of said cam lobes provides the energy to open the valve, while the other cam lobe provides the energy to close the valve;

c) a pair of lifters per valve, each of the lifters rides upon one of said cam lobes, wherein the energy which is obtained from each respective said cam lobes is directed linearly upward toward each respective said geared rockers; and d) a pair of pushrods per each valve, each respective pushrod transfers the energy from one of said lifters to one of said geared rockers.

10. The valve operating mechanism of claim 9, further including a retaining mechanism which attaches one of said geared rockers to a stem of said valve to control said valve during both the valve opening and closing operations.

11. The valve operating mechanism of claim 9, wherein one member from each of said lifter, pushrod, cam lobe, and geared rocker pairs form a set which function together to open the valve, and the other member from each of said component pairs form a set which function together to close the valve, wherein only one of the sets controls the position of said valve at a time.

12. The valve operating mechanism of claim 9, wherein said valve operating mechanism modify an existing engine whereby many components from the existing engine may be reused with minor modifications.

* * * * *